United States Patent [19]

Altenophl et al.

[11] 4,245,453

[45] Jan. 20, 1981

[54] TWO-STAGE OPERATED NOZZLE FOR TIGHT BAGGING SYSTEM

[75] Inventors: William F. Altenophl; Paul J. Altenpohl, both of High Point, N.C.

[73] Assignee: W. F. Altenpohl, Inc., High Point, N.C.

[21] Appl. No.: 6,238

[22] Filed: Jan. 24, 1979

Related U.S. Application Data

[63] Continuation-in-part of Ser. No. 956,994, Oct. 31, 1978, and a continuation-in-part of Ser. No. 845,231, Oct. 25, 1977.

[51] Int. Cl.[3] ..... B65B 63/02; B65B 43/36; B65B 39/02

[52] U.S. Cl. ..... 53/530; 53/572; 53/258; 53/261; 53/385

[58] Field of Search ..... 53/74, 572, 530, 258, 53/260, 261, 385

[56] References Cited

U.S. PATENT DOCUMENTS

| | | | |
|---|---|---|---|
| 3,206,913 | 9/1965 | Fleigher et al. | 53/572 |
| 3,330,093 | 7/1967 | Schorer | 53/572 |
| 3,930,352 | 1/1976 | Carnes | 53/572 |
| 4,023,329 | 5/1977 | Kupcikevicius et al. | 53/261 X |

*Primary Examiner*—Travis S. McGehee

*Attorney, Agent, or Firm*—Clarence A. O'Brien; Harvey B. Jacobson

[57] ABSTRACT

Poutlry dropped from a moving conveyor is loaded into bags through a nozzle assembly that expands each bag in advance of bird entry by means of a two-stage motion. A ram packs each bird fully into the bag during the second stage of nozzle operation followed by detachment of the bag and drop onto a receiving surface.

10 Claims, 10 Drawing Figures

FIG. 6
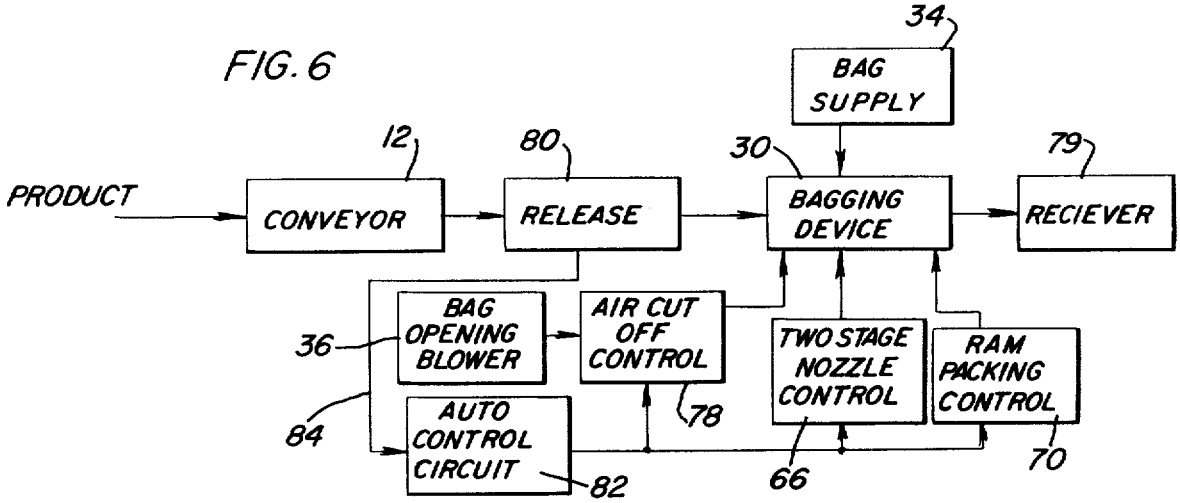
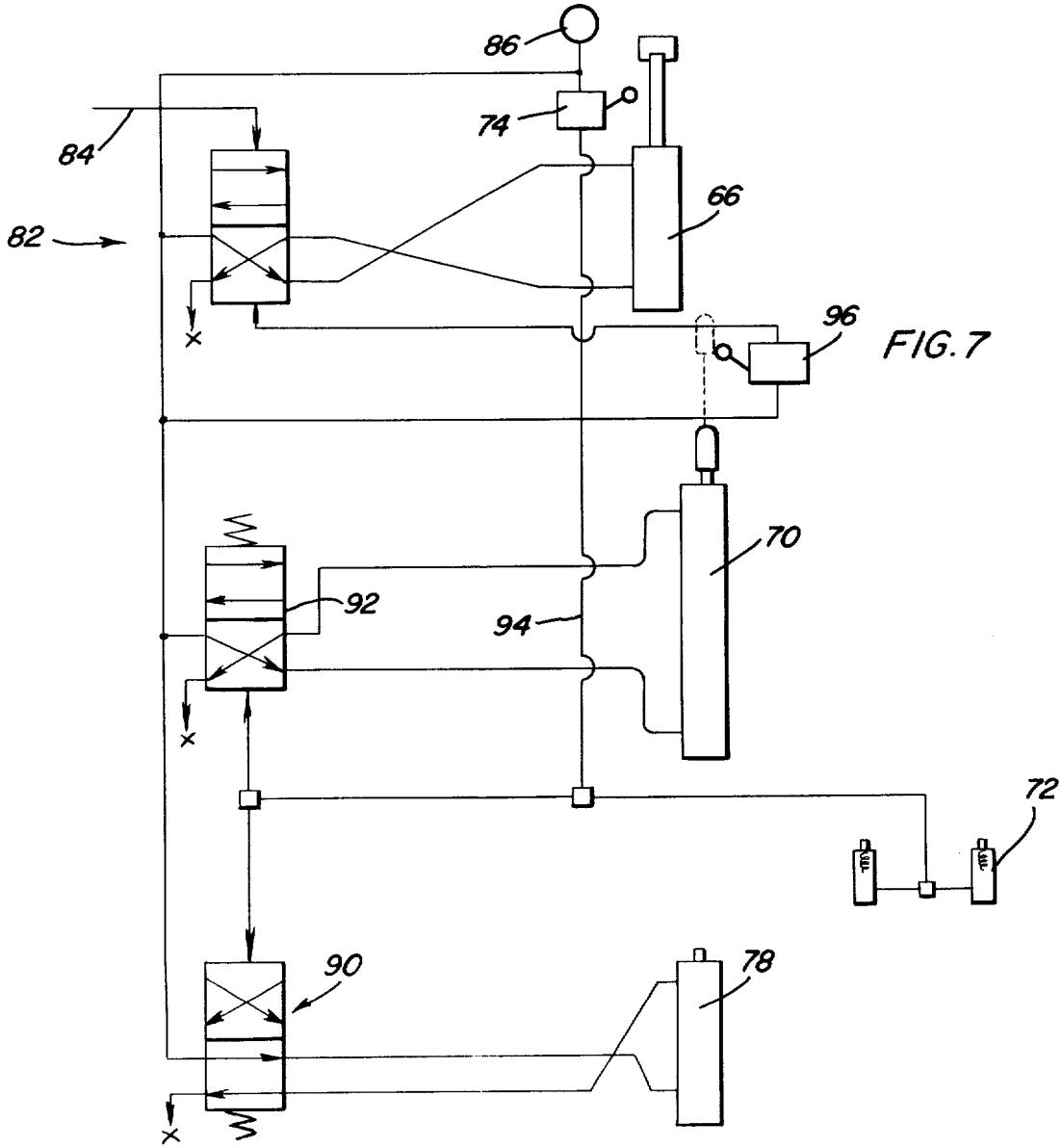
FIG. 7

TWO-STAGE OPERATED NOZZLE FOR TIGHT BAGGING SYSTEM

BACKGROUND OF THE INVENTION

This invention relates to the automatic loading of poultry into flexible film bags and is related to the inventions disclosed in our prior copending applications Ser. Nos. 845,231 and 956,994, filed Oct. 25, 1977 and Oct. 31, 1978, respectively, with respect to which the present application is a continuation-in-part.

According to our prior copending applications, a method and apparatus for packaging poultry in close or tight-fitting bags in an automatic fashion, is disclosed. Although automatic packaging of regular machine-made products within individual packaging containers is well known, because of the irregularities in contour and weight distribution associated with poultry, no automatic tight-fit packaging of poultry suspended from a moving conveyor was deemed to be feasible prior to the invention disclosed in the aforementioned copending application, Ser. No. 845,231, because of tumbling and dimensional interference. It was discovered, however, that automatic packaging could be effected as a practical matter if the birds were suspended in the same orientation from both legs by double hook carriers and dropped from the moving conveyor for limited free fall onto an inclined surface guiding descent of each bird into a flexible film bag inflated by a stream of air from a blower associated with a bagging device having a bag holding rack from which the bags are detached and dropped upon receipt of the product therein. According to the invention disclosed in copending application, Ser. No. 956,994 aforementioned, packaging is achieved with a greater degree of tight-fit by limited expansion of the bag prior to entry of the bird through the nozzle assembly guiding entry.

It is an important object of the present invention to increase the degree of tight fit between the product and the packaging container with greater operational reliability in an automatic packaging operation.

SUMMARY OF THE INVENTION

In accordance with the present invention, poultry dropped from a moving conveyor onto an inclined surface of a bagging device for guided descent into an inflated bag, partially enters the inflated bag through a nozzle assembly projected into the open end of the bag in advance of poultry entry. The nozzle assembly includes laterally spaced, confronting members forming a convergent entry passage that is laterally expanded in two stages to cause dimensional enlargement of the open portion of the bag during the second stage. The bird is pushed through the expanded passage of the nozzle assembly by a ram advanced after initial expansion of the nozzle assembly during the first stage. Withdrawal of the ram and nozzle assembly from the bag permits contraction of the bag material about the bird since the nozzle assembly is contracted from its expanded condition as it is being retracted. The bag is detached from its rack as the bird is fully packed into it by the ram, and drops onto a receiving surface.

Pivotal movement is imparted to the nozzle members during the first stage through a linkage arrangement under constraint of releasable link retarders. The link retarders are released when the end of the first operational stage is detected to both initiate the second stage and advancement of the packing ram. During the second stage, the linkage arrangement is operative to effect translation of the nozzle members in a direction causing dimensional enlargement and detachment of the bag from the rack at the end of the operational cycle. A control circuit is interfaced with the nozzle and ram to control the operational cycle and includes a detector to sense the end of the first stage and initiate the second stage of nozzle operation as aforementioned.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 6 is a schematic block diagram illustrating the control system associated with the present invention.

FIG. 7 is a simplified fluid circuit diagram corresponding to the control system illustrated in FIG. 6.

DETAILED DESCRIPTION OF THE PREFERRED EMBODIMENT

Figure 1:
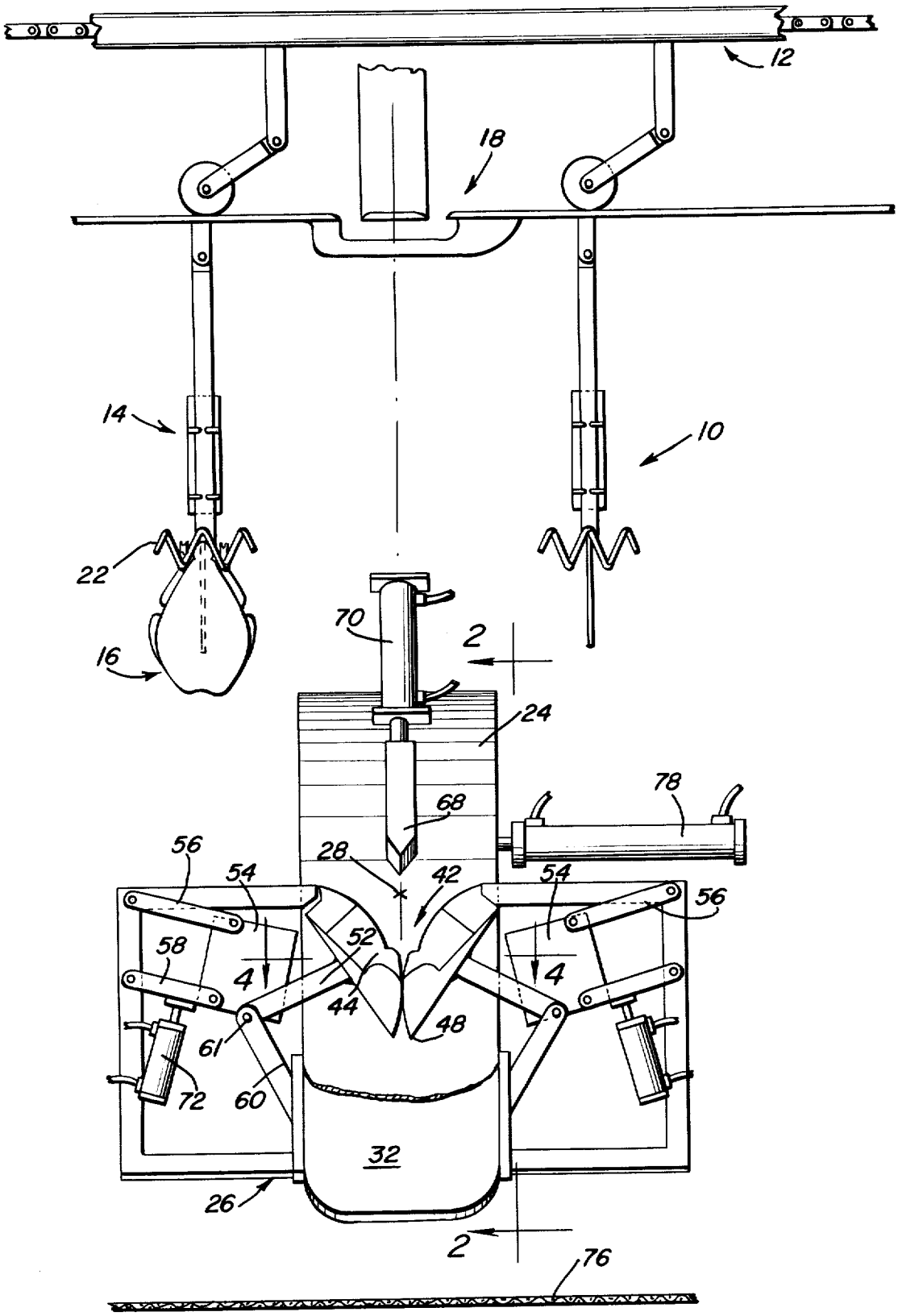
FIG. 1 is a front elevational view showing the typical installation for the present invention.
Figure 2:
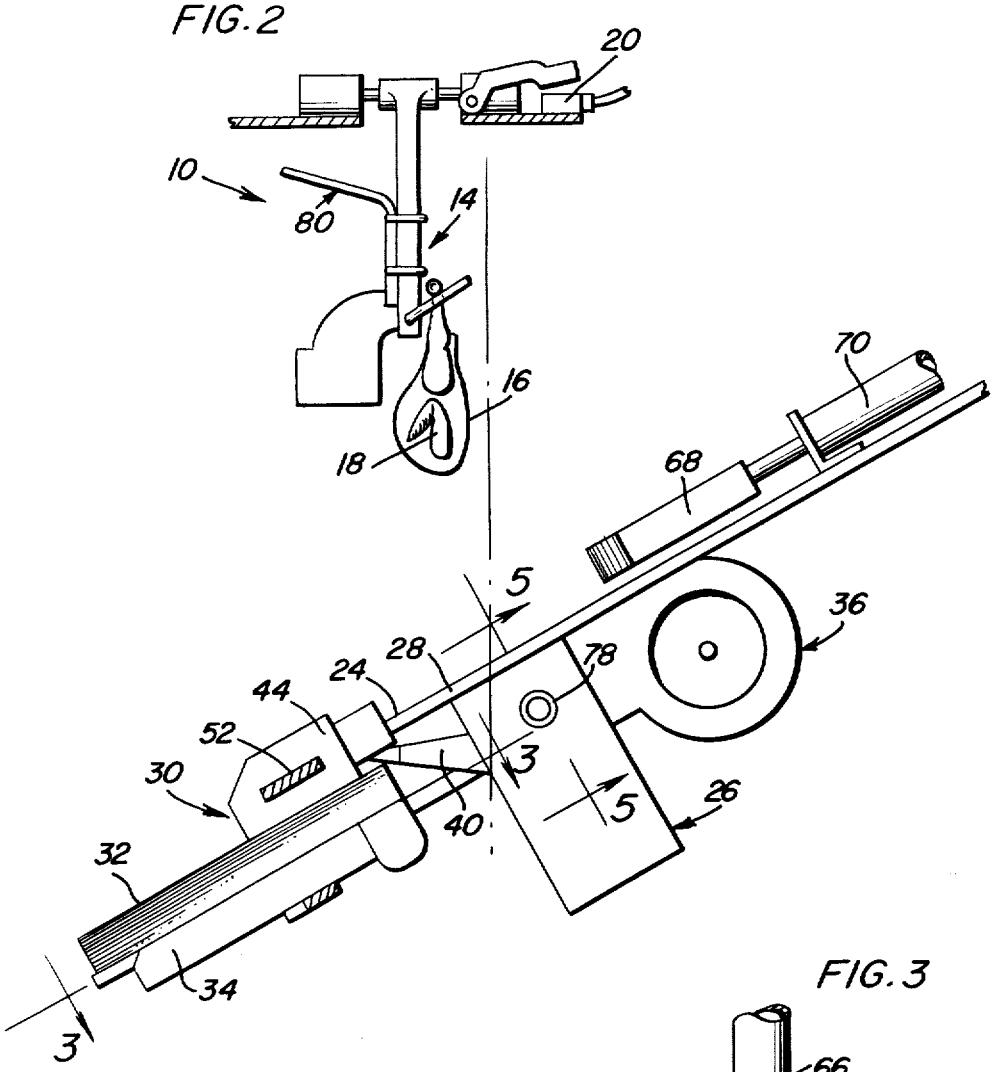
FIG. 2 is a partial side sectional view taken substantially through a plane indicated by section line 2—2 on FIG. 1.

Referring now to the drawings in detail, FIGS. 1 and 2 illustrate an automatic bagging installation generally referred to by reference numeral 10 located below an overhead conveyor 12 in a poultry processing plant. By means of the overhead conveyor 12, poultry carriers generally referred to by reference numeral 14 convey birds 16 to a bagging station 18 at which birds are automatically dropped for limited free fall. In a manner well known in the art, dropping of a bird at the station 18 is detected by a sensor 20 from which a release signal originates. This signal initiates an automatic bagging cycle as will be explained in detail hereinafter.

As disclosed and claimed in our prior copending applications aforementioned, the birds conveyed to the bagging station are suspended by both legs by means of double leg hooks 22 associated with the poultry carrier 14. When released, each bird undergoes a short free fall before impact with a fixed, inclined guide surface 24 supported by a frame assembly generally referred to by reference 26. Impact occurs at a location 28 on the guide surface 24 adjacent its lower end portion forming part of a bagging device generally referred to by reference numeral 30. The bagging device includes a stack of film bags 32 supported on a bag supply rack 34 fixedly mounted in parallel spaced relationship to the guide surface 24. Also associated with such bagging device is an air blower 36 by means of which the top bag on the bag supply rack 34 is inflated through its upper open end 38. Accordingly, an air discharge nozzle 40 underlying the lower end portion of the guide surface 24, directs a stream of air into the open end of the topmost bag 32 in order to cause it to be inflated or opened in preparation for entry of a bird.

In accordance with the present invention, an adjustable nozzle assembly generally referred to by reference numeral 42 is associated with the bagging device in order to establish an entry passage into the topmost bag in advance of a bird undergoing guided descent into the bag. The nozzle assembly 42 includes a pair of confronting nozzle members 44 that are laterally spaced from each other in convergent relation to define a variable cross-sectional area of the entry passage. An actuating linkage assembly generally referred to by reference numeral 50 is mounted by the frame assembly 26 and is connected to each of the guide members 44 in order to effect downward projection of the nozzle assembly into the top opened bag as well as lateral expansion of the nozzle assembly as it is advanced into the bag.

Figure 3:
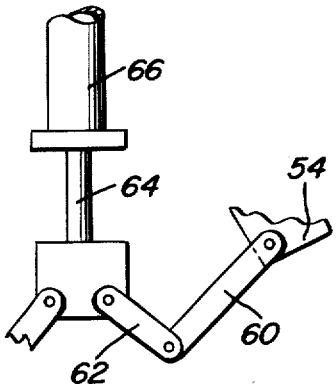
FIG. 3 is a partial sectional view taken substantially through a plane indicated by section line 3—3 in FIG. 2.

As more clearly seen in FIGS. 1 and 3, the actuating linkage assembly 50 includes an arm 52 extending laterally from each nozzle member 44, each arm being pivotally connected to a linkage connector 54 at pivot 61. The connector 54 is interconnected with the frame by means of a pair of parallel links 56 and 58 so as to constrain its movement in a desired path in response to an actuating force applied thereto at pivot 61 through a connecting link 60. Connecting link 60 is connected by means of a link 62 to the end of a piston rod 64 extending from a fluid operated piston actuator 66 as more clearly seen in FIG. 3.

Figure 5:
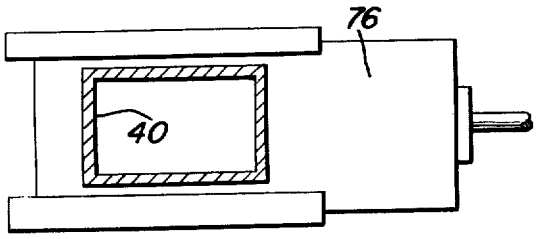
FIG. 5 is a sectional view taken substantially through a plane indicated by section line 5—5 on FIG. 2.
Figure 4:
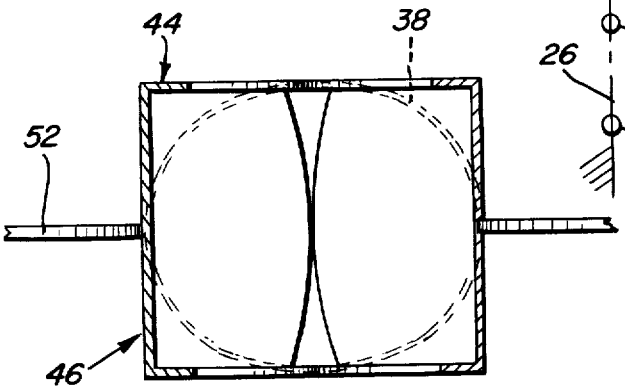
FIG. 4 is a partial sectional view taken substantially through a plane indicated by section line 4—4 in FIG. 1.
Figure 5A:
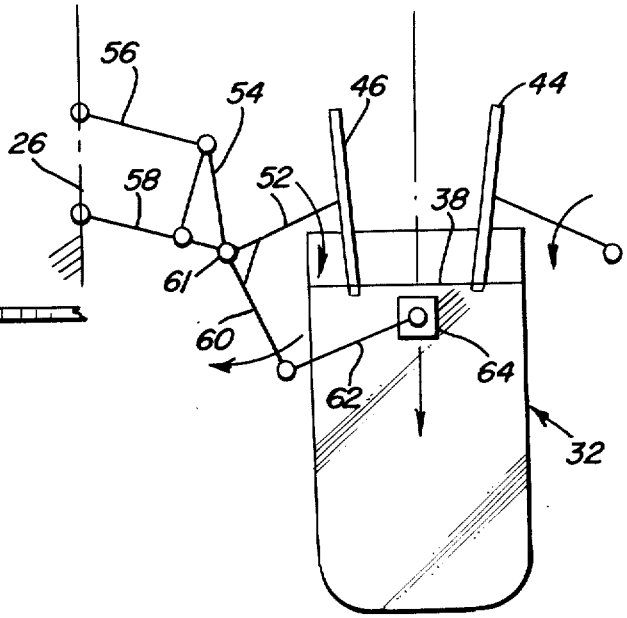
FIGS. 5A–5C are kinematic representations of the nozzle assembly operation in different phases of its operational cycle.
Figure 5B:
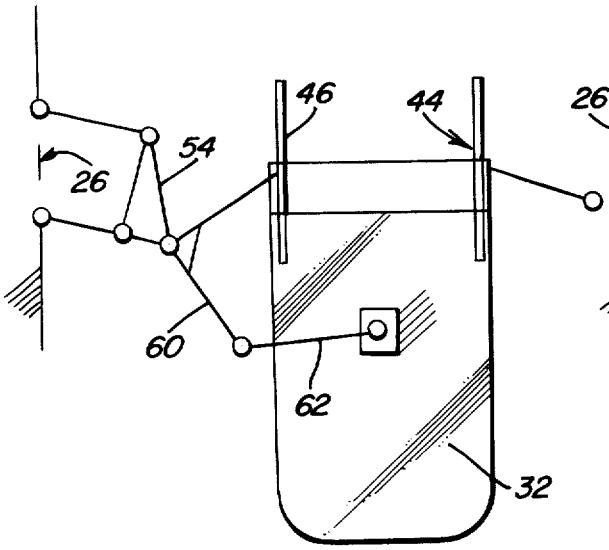
Figure 5C:
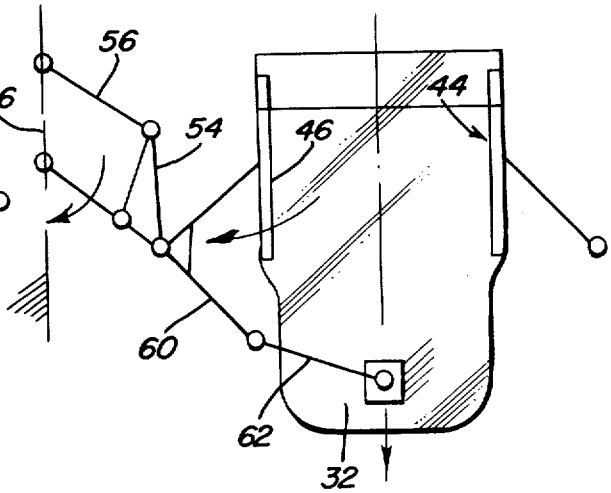

As shown in FIGS. 1 and 4, the nozzle assembly 42 in the retracted position is closely spaced above the bag opening 38 which is generally circular in the inflated condition of the bag. The convergent entry passage formed by the nozzle members 44 is generally rectangular in cross section. FIG. 5A shows the nozzle assembly being projected into the opened bag during a first stage of movement when pivot point 61 is maintained substantionally stationary. Such first stage movement of each nozzle member therefore is pivotal in nature. At the end of such first stage, as shown in FIG. 5B, the outer sides 46 of the nozzle members are substantially parallel to the sides of the bag. The second stage then ensues during which the pivot point 61 is movable to effect translation of the nozzle members laterally outward and axially downward. Enlargement of the opened end portion of the bag and stretching of its film material to some extent is thereby effected as shown in FIG. 5C. Accordingly, entry of the bird into the bag is facilitated. Once the bird is completely enclosed within the bag, the nozzle assembly 44 is contracted laterally as it is being withdrawn so that the expanded bag may contract onto the bird because of its size relative to the bag prior to expansion and produce a tight-fit package.

As shown in FIGS. 1 and 2, a bird packing ram 68 is positioned above the inclined guide surface 24 and connected to the projecting piston rod of a ram actuator 70. The ram is advanced downwardly prarallel to the guide surface 24 by the piston actuator 70 upon completion of the first stage of nozzle movement as the bird partially enters the open bag. As the bag is enlarged by the nozzle assembly 42 during the second stage nozzle movement, the bird is packed into the bag by the ram. The ram is retracted simultaneously with the nozzle assembly 42 after the bird is fully packed into the bag.

When the bird is fully packed into the bag by the ram, the bag becomes detached from the supply rack by the nozzle assembly movement, the gravitational load of the bird and the force applied thereto by the ram. Detachment is occasioned by rupture of the flap of the bag at which the bag is held on the rack as described in our prior copending applications aforementioned.

In order to control the two-stage movement of the nozzle assembly, a fluid retarding device 72 engages each link 58 of the nozzle actuating linkage assembly 50 as shown in FIG. 1 to hold pivot 61 stationary during the first stage. The fluid retarders will therefore constrain links 60 to pivotal movement together with arms 52 connected thereto. When the nozzle members 44 reach positions parallel to the sides of the bag at the end of the first stage, a sensor 74 detecting the end of the first stage corresponding to approximately one-half the travel stroke of piston control 66, initiates the second stage as well as ram movement. Also, the continuous air stream discharge from the blower 36 is cut off temporarily by a slidably displaceable valve plate 76 operatively mounted for movement across the flow area of the discharge nozzle 40 of the blower as more clearly seen in FIG. 5. The air cut off valve plate 76 is connected to an air cut-off valve actuator control 78 of the piston type extending laterally from the frame as more clearly seen in FIG. 1.

FIG. 6 diagrammatically illustrates the control system of the present invention depicting movement of a product in the form of poultry 16 by the conveyor 12 to the bagging station at which it is automatically released by a release mechanism 80 so that the product may drop into the bagging device 30. The bagged bird is then dropped onto a receiver 79. Bags are supplied from a bag supply or bag rack 34 associated with the bagging device which is also operationally controlled by the air cut-off control 78 as aforementioned, by the two-stage nozzle control 66 and the ram packing control 70 as aforementioned. The controls 66, 70 and 78, according to one embodiment of the invention, are supplied with fluid under pressure for operation thereof under control of an automatic control circuit generally referred by reference numeral 82. An automatic bagging cycle is initiated through the control circuit upon receipt of a release signal from sensor 20 aforementioned fed to the control circuit by a pressure signal line 84 as shown in FIG. 6.

The automatic control circuit 82 is shown in FIG. 7. A fluid operating medium is utilized for the various controls aforementioned in the form of pressurized air from a suitable pressure source through line 86 connected to signal operated control valves 88, 90 and 92. Pressurized fluid from line 86 is also supplied through normally open valve sensor 74 to pressure line 94 applying pressure to control valves 90 and 92 to hold the blower cut-off control 78 and ram piston control 70 retracted. The pressurized fluid in line 94 is also applied to the retarders 72 engaged with links 58 to hold the pivot 61 stationary.

An operational bagging cycle is begun by release of a bird at the bagging station producing a pressure signal in line 84 to shift control valve 88 to its other operative position. As a result, the nozzle control 66 projects the nozzle assembly into the open bag in advance of the descending bird by initiating the first stage of operation. The secoond stage of operation is begun by actuation of sensor 74 venting line 94 to depressurize the retarders 72 and remove signal pressure from valves 90 and 92 causing them to shift under spring bias to their other operative positions. Operation of the ram and blower cut off device then occurs during the second stage of operation resulting in the complete packing of the bird within the bag as hereinbefore described. When the ram 68 completes its operational stroke, a limit sensor 96 is engaged to apply a valve reversing pressure signal to the control valve 88 causing reversal of the nozzle control 66. The sensor 74 is then released to repressurize line 94 causing actuation of valves 90 and 92 and simultaneous retraction of the ram and air cut off controls to complete an operational cycle.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a moving conveyor from which an object is dropped at a bagging station for guided gravitational descent along an entry passage into an opened bag, nozzle means for establishing said entry passage, control means connected to the nozzle means for projection thereof into the bag in two stages of operation, and ram means for packing the object into the bag following partial entry thereof during a first of said two stages.

2. The combination of claim 1 including blower means for inflation of the bag prior to drop of the object at the bagging station and means for interrupting said inflation of the bag by the blower means during the second of said two stages.

3. The combination of claim 2 including means for expanding the nozzle means during projection thereof into the bag to cause dimensional enlargement of the bag during the second of said two stages.

4. The combination of claim 3 wherein said object is a bird suspended by both legs from the conveyor.

5. The combination of claim 4 wherein said nozzle means includes a pair of confronting members between which the entry passage is formed, and linkage means connected to the members for pivotal movement during the first stage and translatory movement during the second stage.

6. The combination of claim 1 wherein said nozzle means includes a pair of confronting members between which the entry passage is formed, and linkage means connected to said members for pivotal movement during a first of said two stages and translatory movement during the second of said two stages.

7. The combination of claim 6 including the blower means for inflation of the bag prior to drop of the object at the packaging station and means for interrupting said inflation of the bag by the blower means during the second of said two stages.

8. In combination with a moving conveyor from which a compressible object is dropped at a bagging station for free-fall impact with a fixed guide along which the object gravitationally descends into a flexible container having an opened end portion, nozzle means projected into the opened container during said descent of the object along the fixed guide, control means operatively connected to the nozzle means for expansion thereof to enlarge said opened end portion of the container and for withdrawal of the nozzle means following entry of the object into the container, said compressible object being of a size relative to the container to produce a tight fit package by contraction of the container onto the object in response to said withdrawal of the nozzle means, reciprocable ram means engageable with the object only after partial entry thereof into the enlarged container for displacing the object fully into the container, and means for withdrawing the ram means from the container simultaneously with said withdrawal of the nozzle means.

9. In combination with a moving conveyor from which an object is dropped at a bagging station for guided gravitational descent along an entry passage into an opened bag, nozzle means for establishing said entry passage, control means connected to the nozzle means for projection thereof into the bag in two stages of operation, and ram means engageable with the object only during one of said two stages for packing the object into the bag following partial entry thereof during the other of said two stages, said bag being dimensionally expanded by the nozzle means during said one of the two stages.

10. The combination of claim 9 wherein said object is of a size relative to the bag to enable contraction of the expanded bag onto the object in response to withdrawal of nozzle means following the two stage projection thereof into the bag.

* * * * *